US006735906B1

(12) United States Patent
Largent

(10) Patent No.: US 6,735,906 B1
(45) Date of Patent: May 18, 2004

(54) WARP RESISTANT ACCESS DOOR ASSEMBLY FOR A HIGH TEMPERATURE COMBUSTION CHAMBER

(76) Inventor: Thomas R. Largent, 4821 Mountain Lakes Blvd., Redding, CA (US) 96003

( * ) Notice: Subject to any disclaimer, the term of this patent is extended or adjusted under 35 U.S.C. 154(b) by 0 days.

(21) Appl. No.: 09/477,918

(22) Filed: Dec. 31, 1999

(51) Int. Cl.[7] ..... E05D 15/00; F23M 7/00
(52) U.S. Cl. ..... 49/381; 126/190; 110/176
(58) Field of Search ..... 49/386, 381, 501, 49/324; 126/224, 190, 191; 110/173, 176

(56) References Cited

U.S. PATENT DOCUMENTS

| | | | | |
|---|---|---|---|---|
| 1,415,990 | A | | 5/1922 | Carstens |
| 1,863,054 | A | * | 6/1932 | Hutton et al. |
| 1,993,786 | A | * | 3/1935 | Hollender |
| 2,081,113 | A | * | 5/1937 | Anderson |
| 2,396,663 | A | * | 3/1946 | Kuehlthau et al. |
| 2,494,713 | A | * | 1/1950 | Longenecker |
| 2,532,841 | A | * | 12/1950 | Hanff |
| 2,714,359 | A | * | 8/1955 | Seaver |

(List continued on next page.)

FOREIGN PATENT DOCUMENTS

| | | |
|---|---|---|
| DE | 622757 | 12/1935 |
| DE | 1223811 | 3/1963 |
| DE | 3109781 | 3/1981 |
| FR | 2215586 | 1/1973 |
| JP | 7004856 | 1/1995 |
| WO | WO 93/09381 | 3/1993 |

OTHER PUBLICATIONS

Search Report, International PCT application PCT/US00/35563; Cover + 2 pages of notes; pp. 1 thru 4, Mar. 15, 2001.
Search Report, International PCT application PCT/US00/42163; Cover + 2 pages of notes; pp. 1 thru 4, Mar. 26, 2001.

*Primary Examiner*—Hugh B. Thompson, II
(74) *Attorney, Agent, or Firm*—John P. O'Banion

(57) ABSTRACT

A warp resistant fuel feed door assembly for use in injecting supplemental fuel into a high temperature combustion chamber such as a rotating cement kiln without substantial loss of heat or combustion gases. The apparatus, which is positioned on the exterior side of a fuel passage transecting the wall of a rotating kiln, opens to receive fuel and then seals during the balance of the rotation of the kiln. Warping, bearing fracture, shaft distortion and jamming due to exposure to extreme heat and cooling are minimized by the sectional construction of the doors. The door includes a plate positioned over the mouth of the passage, a plurality of support arms attached to the plate and a hinge shaft attached to the arms. Stresses on the door structure from inconsistent expansion of the plate are reduced due to symmetrically spaced oblong and oversized bolt attachment bores in the support arms. Synchronous opening of the feed doors is achieved by levered rotation of the hinge shafts by an electric motor. Selective introduction of supplemental fuel into a rotating kiln can be controlled by electrical actuation of the feed doors.

26 Claims, 6 Drawing Sheets

U.S. PATENT DOCUMENTS 2,735,386 A * 2/1956 Longenecker
2,813,822 A 11/1957 Collier
2,824,762 A 2/1958 Kaiser
3,083,846 A 4/1963 Walker et al.
3,357,689 A 12/1967 Arneson et al.
4,370,973 A * 2/1983 Bolanos ..... 165/58
4,551,051 A 11/1985 Hofbauer et al.
4,694,820 A * 9/1987 Buckner ..... 126/289
4,844,292 A 7/1989 Lonardi et al.
4,850,290 A 7/1989 Benoit et al.
4,930,965 A 6/1990 Peterson et al.
4,974,529 A 12/1990 Benoit et al.
5,058,513 A 10/1991 Benoit et al.
5,078,594 A 1/1992 Tutt et al.
5,083,516 A 1/1992 Benoit et al.
5,221,019 A * 6/1993 Pechacek et al. ..... 220/315
5,224,433 A 7/1993 Benoit et al.
5,226,774 A 7/1993 Tutt et al.
5,377,603 A 1/1995 Reese et al.
5,473,998 A 12/1995 Allen et al.
5,724,899 A 3/1998 Reese et al.
5,806,442 A 9/1998 Aldred et al.
5,806,654 A 9/1998 Largent
6,086,026 A * 7/2000 Pearce ..... 248/127
6,302,684 B1 * 10/2001 Woo et al. ..... 432/250

* cited by examiner

WARP RESISTANT ACCESS DOOR ASSEMBLY FOR A HIGH TEMPERATURE COMBUSTION CHAMBER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to high temperature kiln access door assemblies, and more particularly to a warp resistant supplemental fuel feed door assembly for a rotating kiln.

2. Description of the Background Art

Rotating cylindrical kilns are frequently used in the production of cement. Because such kilns operate at extremely high temperatures, it is possible to burn various forms of liquid and solid combustible waste materials as a source of supplemental heat. Waste materials tend to completely combust at the high operating temperatures found in such kilns, which are on the order of 3400 degrees Fahrenheit and above, while producing little or no undesirable gaseous or solid emissions. Therefore, these waste materials can serve as a form of supplemental fuel, thereby reducing the demand for and cost of the primary fuel.

Worn rubber vehicle tires are particularly suited as a supplemental fuel for a rotary cement kiln. The extremely high temperatures within a cement kiln will cause the rubber tires to burn without any significant liquid, solid or gaseous waste byproducts which might otherwise be detrimental to the environment. Since worn out tires currently present a disposal problem, burning the tires in rotary kilns helps alleviate the growing problem of disposal without impairing the environment.

Various secondary fuel feed mechanisms have been developed to introduce fuel through a kiln wall into the interior of a rotating cylindrical kiln. Typically, these feed systems have an entrance chute which transects the kiln wall with an outer portion protruding through the outer wall of the kiln and an inner portion protruding into the interior of the kiln. The outer portion of the chute normally includes a feed door which opens to allow passage of the secondary fuel into the kiln. Some feed systems positively inject the supplemental fuel into the kiln using a ram or advancing screw mechanism. Other feed systems known tend to use gravity to inject the supplemental fuel into the kiln. A kiln feed door is utilized in both systems to prevent the escape of heat and combustion gases when the supplemental fuel is fed into the interior of the kiln.

The repetitive opening and closing of the kiln feed door results in the exposure of the door to higher temperatures when closed and lower temperatures when open. Such heating and cooling of the door results in expansion and contraction of the door surfaces and warping of the door over time. Warped doors do not properly seal against the entrance chute and allow heat and combustion gases to escape when the door is closed. Replacement of the warped kiln feed door can be costly requiring the kiln to be shut down during the time a new door is installed.

In addition, most door actuating mechanisms are mechanically controlled by the use of cams or rollers and operate within a fixed operating cycle. Such mechanical mechanisms must open the door on each revolution of the kiln and can not skip a cycle. Thus, the rate of secondary fuel introduced into the kiln can not be modified efficiently.

Accordingly, there is a need for a kiln feed door that is resistant to warpage when repetitively exposed to hot and cold temperatures, and which can be opened and closed such that the rate of secondary fuel can be varied. The present invention satisfies those needs, as well as others, and generally overcomes deficiencies found in convention kiln feed door assemblies.

BRIEF SUMMARY OF THE INVENTION

The present invention is a kiln feed door assembly that restricts the loss of heat and combustion gases when feeding tires and other combustible materials into a rotating kiln as a source of supplemental fuel. By way of example, and not of limitation, the apparatus comprises a kiln feed door assembly that preferably includes two feed doors pivotally mounted to a baseplate on the exterior entrance of a chute which transects the wall of the rotary kiln. Each door includes a pivot shaft which preferably pivots within two high temperature pillow block bearings. Preferably four door plate mounting arms are attached to the pivot shaft and extend radially from the center of the pivot shaft. Planar rectangular door plates are mounted to the mounting arms with bolts secured through bores or apertures in the mounting arms.

In the preferred embodiment, there are at least two apertures in each mounting arm. The apertures are matched in pairs in each mounting arm. Some apertures are oblong in shape with the lengthwise portion of the aperture aligned with the direction of the width of the mounting arm. Other oblong apertures are aligned such that the lengthwise portion of the aperture is in the direction of the length of the mounting arm and perpendicular to the length of the pivot shaft. Still other apertures are circular. Each aperture may be sized to receive a bushing.

The bushings and linear alignment of the oblong apertures allow the door plates to expand and contract inconsistently without causing stress or otherwise warping the door. An efficient seal against the loss of heat and combustion products is maintained when the door plates keep their planer shape.

The two kiln doors pivot outwardly from the base plate and center of the kiln. One door assembly has a lip on the outer surface of the door. The lip is positioned to cover and seal the small space between the doors when the doors are in the closed position.

Each kiln feed door of the door assembly is preferably counterbalanced on the pivot shaft, preferably with two counterweights, one disposed near each of the block bearings. The door and counterweights are equally balanced with respect to the pivot shaft allowing for the opening and closing of the doors with little effort.

In one preferred embodiment, the kiln doors synchronously open and close using an electric motor, gearbox, actuating arms, rods and transfer arms. An actuating arm is radially mounted to one end of the pivot shaft of one door and a transfer arm is radially mounted to the other end of the shaft. The actuating arm is connected by an actuating rod to a rotating armature from the gearbox. This portion of the mechanism translates the rotational motion of the armature to oscillating motion of the actuating arm and partial rotation of the pivot shaft. Rotation of the pivot shaft results in movement of the transfer arm. An elongate transfer rod is pivotally connected to the transfer arm on one end and to an arm mounted to the pivot shaft of the opposing door on the other. Therefore, both kiln feed doors open simultaneously when the electric motor is activated.

In operation, tires or other combustible materials are presented to a feed ramp or injection platform. As the kiln rotates, the feed door assembly eventually comes into proper alignment with the feed ramp. The kiln feed doors are mechanically or preferably electrically opened to allow the kiln to receive the combustible materials from the ramp. The doors are closed after the combustible material enters into the kiln to eliminate the loss of heat and combustion products from the kiln during rotation.

An object of the invention is to provide secondary fuel access doors for a rotating kiln that can expand linearly or laterally without warping.

Another object of the invention is to provide kiln feed doors that will efficiently prevent the escape of heat and combustion products from the interior of the kiln yet allow the efficient entry of tires or other combustible material into the kiln Another object of the invention is to provide a kiln feed door that can be repetitively exposed to heat extremes and cooling and maintain its shape.

Yet another object of the invention is to provide a door actuating mechanism that efficiently and reliably allows momentary access to the interior of the kiln without releasing large amounts of heat or combustion gases.

Still another object of the present invention is to provide a kiln supplemental fuel feed door assembly that can be programmed to open and close at desired times and is capable of skipping cycles.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 6, where like reference numbers denote like parts. It will be appreciated that the apparatus may vary as to configuration and as to details of the parts without departing from the basic inventive concepts disclosed herein.

Figure 1:
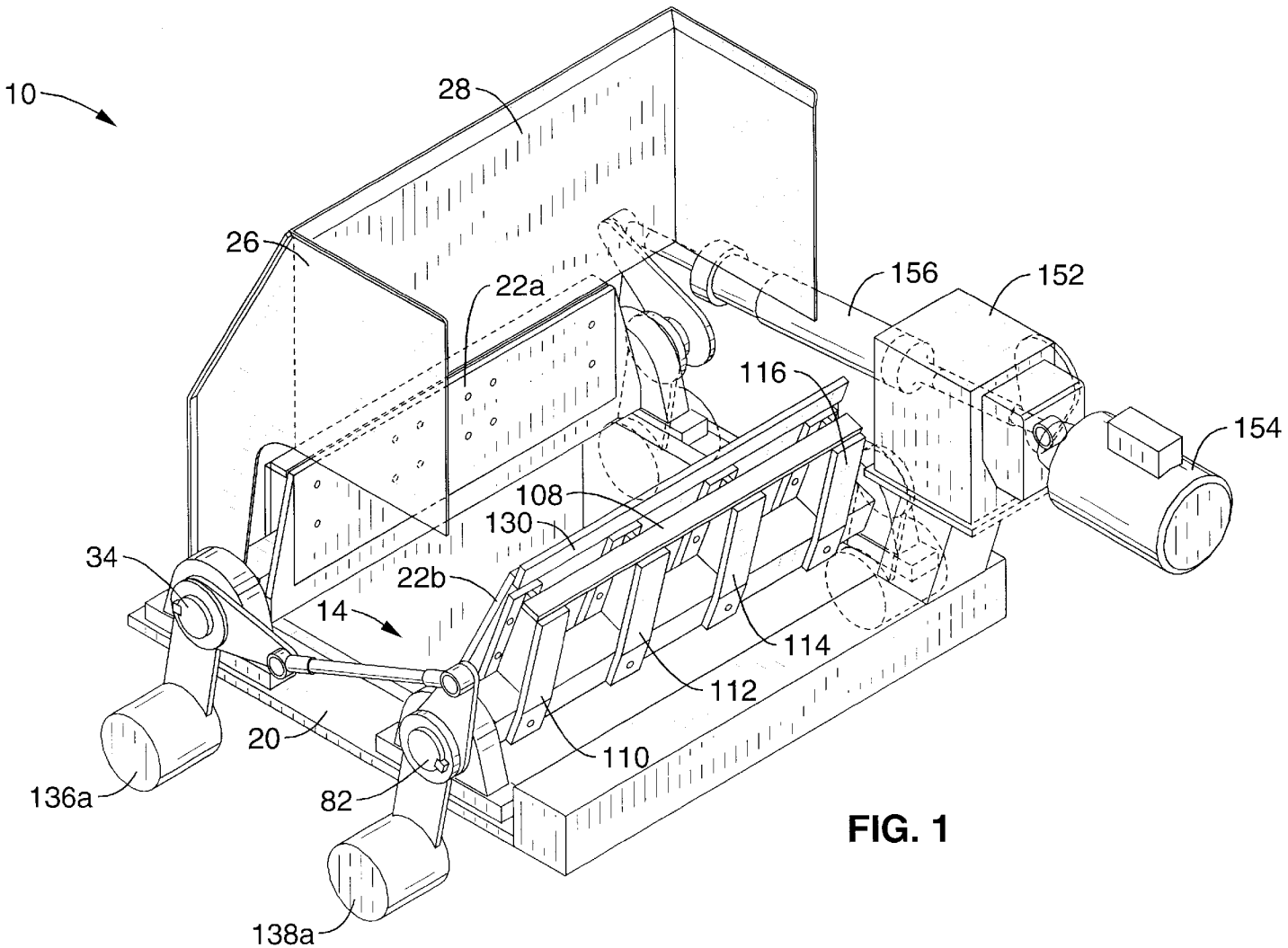
FIG. 1 is a perspective view of a feed door assembly according to the present invention showing the warp resistant doors in the open position.
Figure 2:
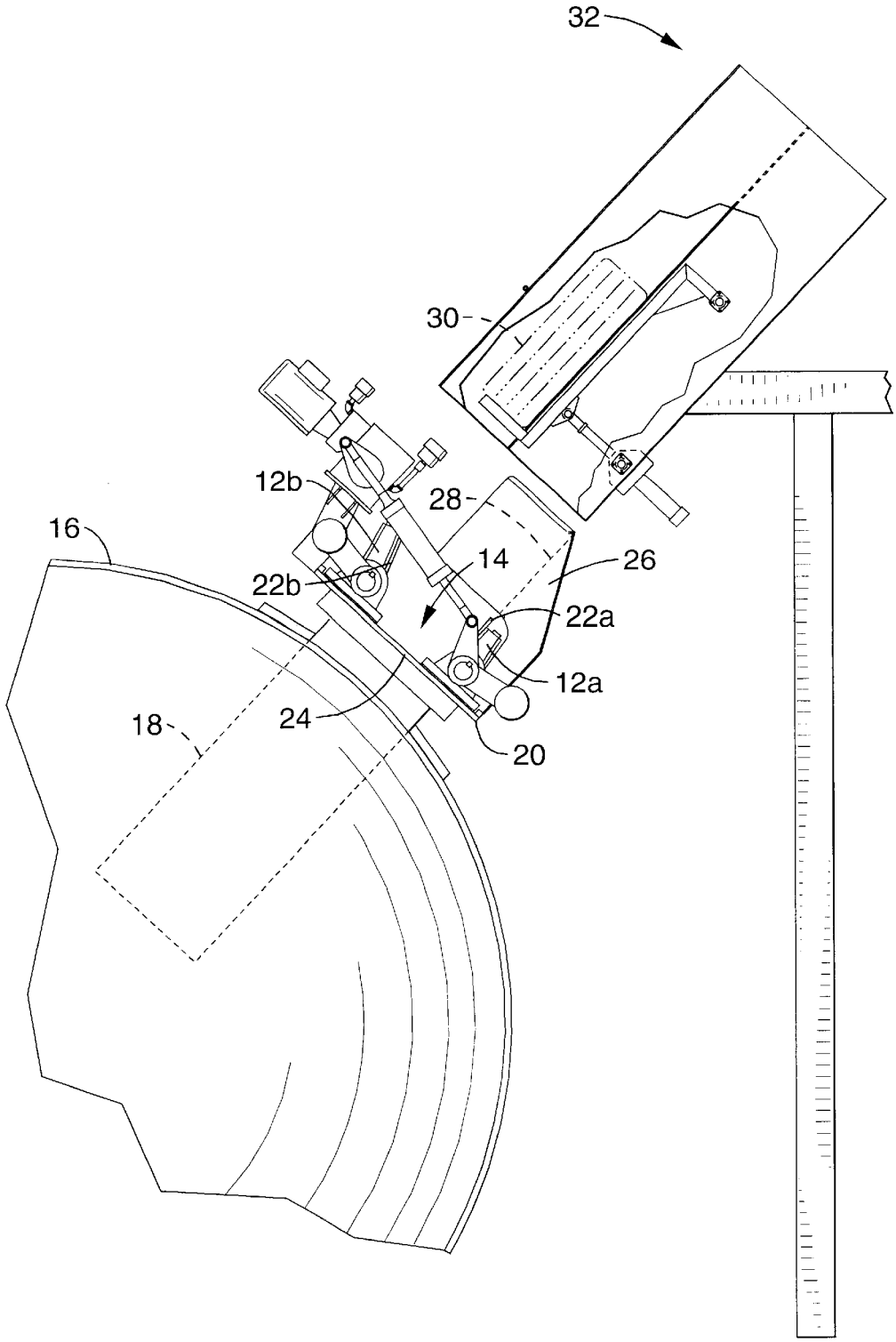
FIG. 2 is a side view of the feed door assembly of the invention with the doors shown in the open position, and showing the feed door assembly in relation to the fuel guide of a rotating kiln and a feed chute.

Referring first to FIG. 1 and FIG. 2, the invention comprises a kiln access door assembly 10 that is used to allow the injection of combustible material into a rotating kiln of the type that is commonly used in the production of cement. The invention includes a pair of outwardly opening warp resistant feed doors 12*a*, 12*b* which provide access to a feed opening 14 in the side wall of a kiln 16. It will be appreciated, however, that the present invention can be used with any combustion chamber such as a stationary kiln, furnace or boiler that exposes an access door to high temperatures. As can be seen, feed opening 14 is at the exterior end of a fuel feed inlet tube 18 which transects the sidewall of the kiln.

In the configuration shown in FIG. 1 and FIG. 2, the feed door assembly 10 of the invention is supported by a baseplate 20 mounted on the exterior end of feed tube 18. Feed opening 14 is an opening in baseplate 20 that allows the passage of combustible material to the interior of the kiln through feed tube 18.

Doors 12*a* and 12*b* include door plates comprising planar members 22*a* and 22*b*, respectively, which face the interior of the kiln when the doors are in the closed position. Preferably, the periphery of feed opening 14 has a lip 24 that engages the face of planar members 22*a* and 22*b* sealing the opening when doors 12*a* and 12*b* are closed.

A fuel guide 26 is mounted on the baseplate 20 such that the plane of surface 28 of the guide is perpendicular to the baseplate. Preferably door 12*a* opens to a position that is perpendicular to the baseplate and then stops. Fuel guide 26 is positioned such that guide surface 28 is substantially contiguous with the inner surface of planar member 22*a* when the door is open. In this manner, tires and other combustible materials can be deposited on the surface 28 of fuel guide 26 and slide by the forces of gravity along the guide and the surface of door member 22*a*, and through the interior of feed tube 18 into the interior of the kiln as the kiln rotates.

Door 12*b* preferably opens to a position approximately one-hundred and ten degrees from horizontal and then stops. This positioning effectively directs stray fuel into the feed opening 14 as it slides down the guide and into feed opening 14.

In FIG. 2, a tire 30 is shown positioned in a feed chute apparatus 32 for delivery into the kiln. In operation, the timing of the release of the fuel from the feed chute should be coordinated with the opening of the doors 12*a* and 12*b* when in the proper position to receive the fuel. In this regard, it will be appreciated that it is important that the tires not be released from the feed chute apparatus until the feed doors on the kiln are in position and opened to receive the tires. In addition, to ensure that the tires will be gravity fed into the kiln, the feed chute is oriented on the support frame such that the plane of the internal ramp (bottom wall) has an angle of inclination between approximately 33 degrees and approximately 60 degrees, and preferably 47 degrees. The feed chute apparatus with rate regulation capability described in detail in co-pending application Ser. No. 09/448,570 filed on Nov. 23, 1999, which is incorporated herein by reference, can be used for this purpose. It will be appreciated, however, that the feed door assembly of the present invention can also be used with other feed mechanisms known in the art that actively inject the fuel into the kiln without the assistance of gravity.

Figure 3:
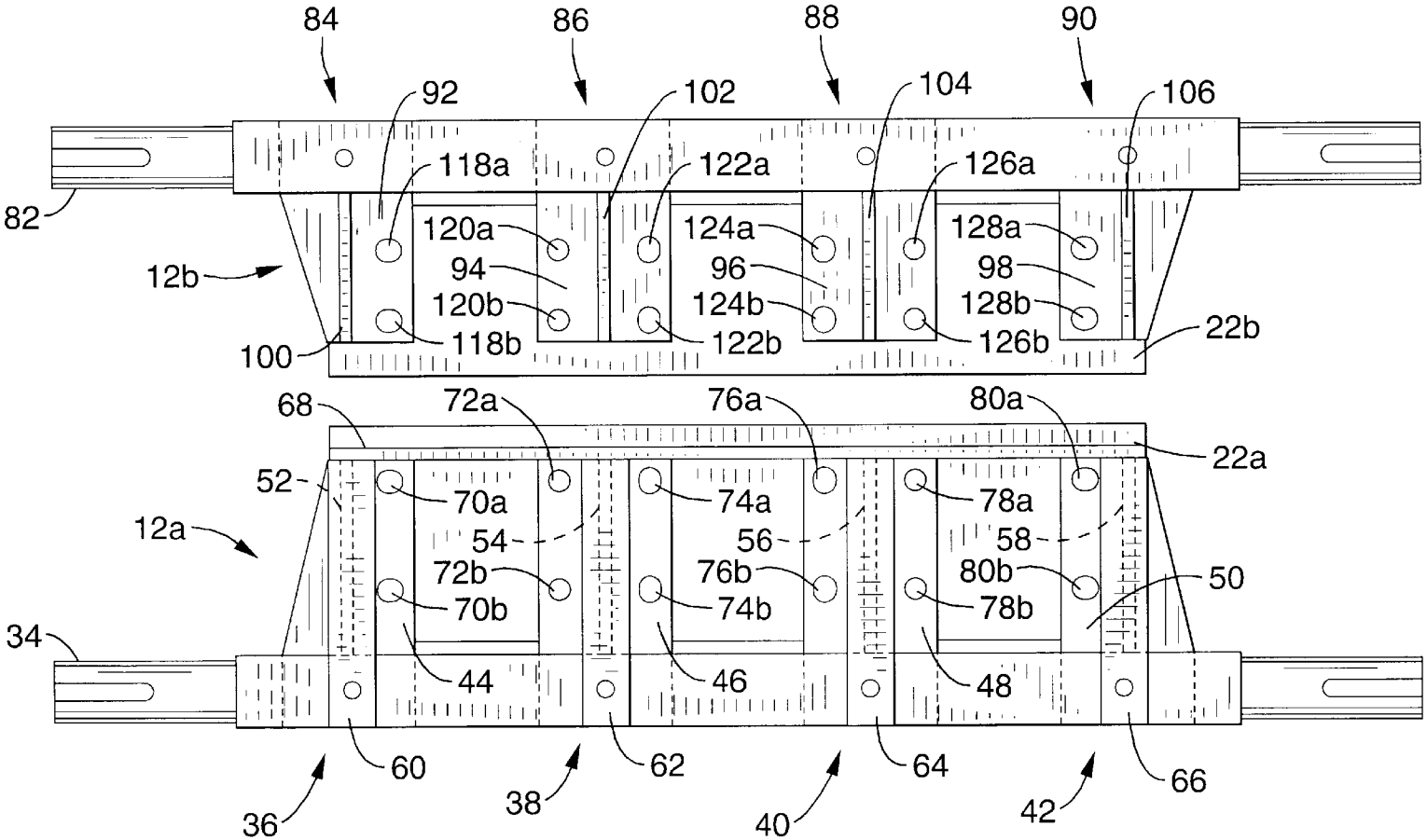
FIG. 3 is a top view of the warp resistant doors of the present invention showing the positioning of the bores in the arms and pivot shafts, and showing one of the doors partially cut away for clarity.

Referring also to FIG. 3, the preferred embodiment of the warp resistant feed doors are shown in greater detail. It will be appreciated that the various components described herein can be attached using conventional fastening techniques, such as welding, bolts, pins or the like, as appropriate for the type of attachment made. In the embodiment shown, doors 12*a* and 12*b* each have a pivot shaft, a plurality of support arms mounted to the shaft and a planar member secured to the arms. Specifically, door 12*a* includes a pivot shaft 34 which functions as a hinge and which preferably has grooves to receive splines at both ends. A plurality of arms 36, 38, 40, and 42 are oriented substantially parallel in the same direction and are securely mounted to shaft 34. Each arm preferably has a horizontal anchor 44, 46, 48 and 50, respectively, which serves as an attachment point with planar member 22*a*. Each horizontal anchor is supported by a vertical upright which is perpendicular to the horizontal plane of the anchor. Vertical uprights 52, 54, 56 and 58 are attached to pivot shaft 34 as well as to its respective horizontal anchor. Each vertical upright has a top plate 60, 62, 64, or 66, respectively, attached on the side opposite the anchor.

Top plates 60, 62, 64, and 66 are also attached to pivot shaft 34 providing additional strength and rigidity to the door. Further rigidity for door 12*a* is provided by a cross-brace or beam 68 which cross-links the vertical uprights of the anchor arms.

Each of the horizontal anchors has one or more pairs of apertures which receives bolts or the like to secure the planar members to the anchors. For example, horizontal anchor 44 has a pair of apertures 70*a* and 70*b* that have a generally oblong shape with the lengthwise portion of the oblong oriented substantially parallel to the length of shaft 34 and substantially perpendicular to the length of anchor 44. In other words, the longitudinal axis through the oblong portion of the aperture is generally aligned with the longitudinal axis of the shaft and generally offset with the longitudinal axis of the anchor by approximately ninety degrees.

Horizontal anchor 46 has two pairs of apertures 72*a*, 72*b* and 74*a*, 74*b* that are preferably disposed on either side of vertical upright 54. Apertures 72*a* and 72*b* are oversized and circular in shape. In contrast with apertures 70*a* and 70*b*, apertures 74*a* and 74*b* have a generally oblong shape with the lengthwise portion of the oblong oriented substantially perpendicular to the length of shaft 34 and generally parallel to the length of the anchor. In other words, the longitudinal axis through the oblong portion of the aperture is offset in relation to the longitudinal axis of the shaft by approximately ninety degrees and is generally aligned with the longitudinal axis of the anchor.

Apertures 76*a* and 76*b* in anchor 48 have the same oblong dimensions as apertures 74*a* and 74*b* and are oriented in the same direction generally perpendicular to the length of the shaft 36 and aligned with the length of the anchor. Likewise, apertures 78*a* and 78*b* are circular and preferably have the same dimensions as apertures 72*a* and 72*b*.

Anchor 50 has apertures 80*a* and 80*b* which are oblong oriented in a direction substantially parallel to the direction of length of shaft 34 and substantially perpendicular to the length of the anchor. Preferably, apertures 80*a* and 80*b* have the same dimensions as apertures 70*a* and 70*b* in anchor 44.

One skilled in the art will appreciate the symmetry of the placement of apertures 70*a* through 80*b*. While this symmetry is preferred, other combinations and placements are anticipated. The orientation and placement of the apertures 70*a* through 80*b* allow the expansion and contraction of planar member 22*a* due to the high temperature gradients associated with opening and closing the doors to occur without causing significant deformation to the door assembly. In addition, appropriately sized bushings may alternatively be placed in the apertures to further reduce stresses. Thus, expansion and contraction of the inventive door assembly from exposure to extreme temperatures does not create sizeable stresses in the door assembly causing warping and a loss of door seal to escaping combustion gases.

Kiln feed door 12*b* has essentially the same structure as feed door 12*a* as can be seen in FIG. 3. Pivot shaft 82 preferably has four mounting arms 84, 86, 88, and 90 which are secured to pivot shaft 82. Each arm has horizontal anchors 92, 94, 96, and 98, respectively, which are ultimately secured to planar member 22*b*. Each anchor has a vertical upright 100, 102, 104 and 106, respectively, mounted radially to shaft 82 and perpendicularly to horizontal anchors 92, 94, 96, and 98, respectively. The vertical uprights are preferably cross-linked by beam 108 to provide strength to the mounting arm assembly. Top plates 110, 112, 114 and 116 are mounted to the vertical uprights on the side opposite the horizontal anchor as well as shaft 82 providing further rigidity to the assembly as shown in FIG. 1. Note that cross beam 108, cover 130 and top plates 110, 112, 114 and 116, can be seen in FIG. 1, but have been omitted from FIG. 3 for clarity.

The apertures in the horizontal anchors of arms 92, 94, 96 and 98 share the same shape, symmetry, placement and orientation as those apertures in anchors 44, 46, 48 and 50 of door 12*a*. Apertures 118*a* and 118*b* in anchor 92 are oblong shaped with the lengthwise portion of the oblong oriented in the direction of the length of shaft 82. Apertures 120*a*, 120*b* and 122*a* and 122*b* are disposed in anchor 94. Apertures 120*a* and 120*b* are circular in shape, and apertures 122*a* and 122*b* are oblong in shape with the lengthwise portion of the oblong perpendicular to the length of shaft 82.

Horizontal anchor 96 has apertures 124*a* and 124*b* which are oblong in shape and 126*a* and 126*b* which are circular in shape disposed on either side of upright 104. The lengthwise portion of oblong apertures 124*a* and 124*b* is perpendicular to the length of shaft 82.

Anchor 98 has apertures 128*a* and 128*b* which are oblong in shape and oriented so that the lengthwise portion of the oblong is parallel to the length of shaft 82. As can be seen, therefore, door 12*b* preferably maintains the same symmetry with respect to the apertures as door 12*a* as seen in FIG. 3.

Figure 4:
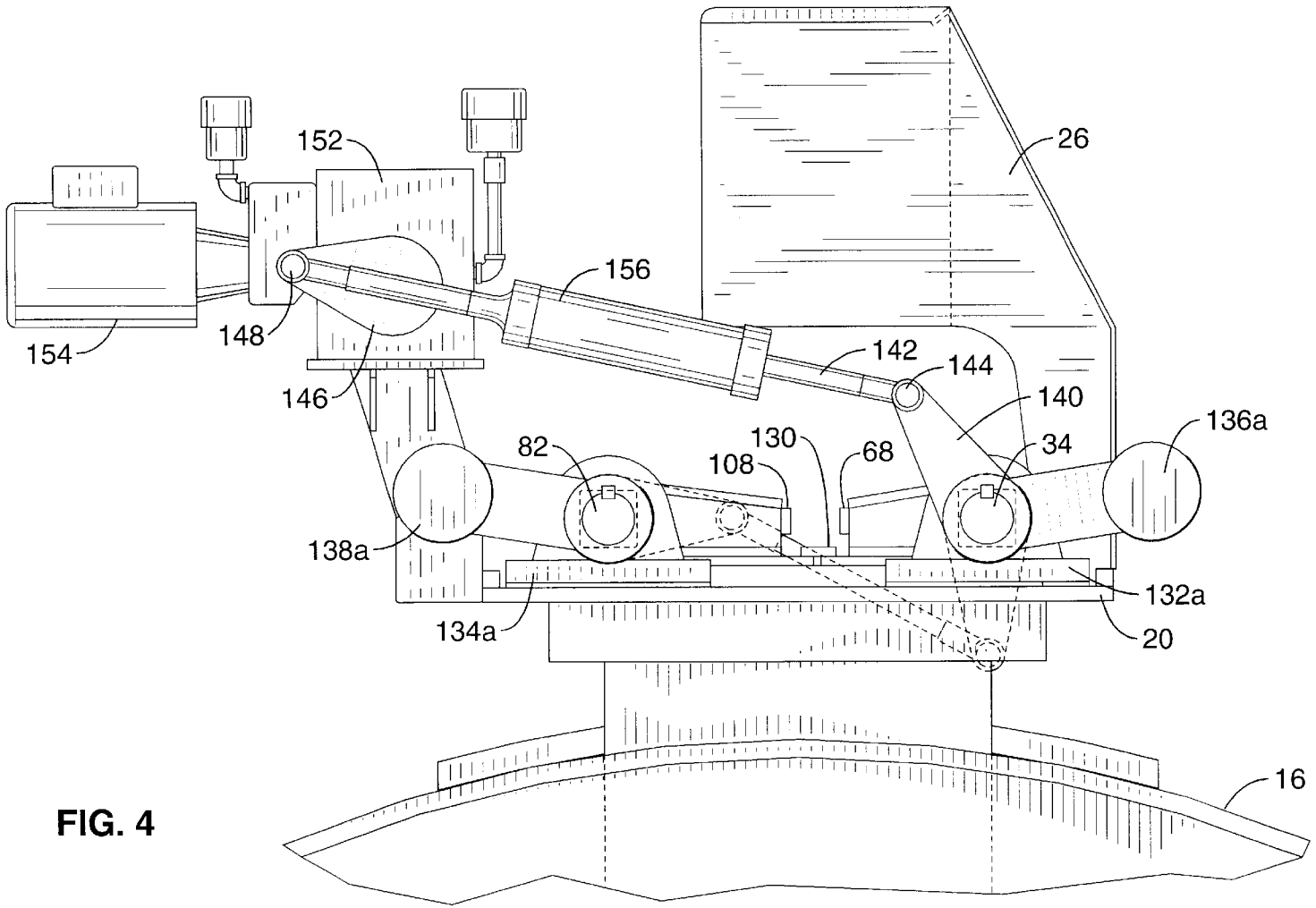
FIG. 4 is a front view of the feed door assembly of FIG. 1 with the warp resistant doors shown in the closed position.
Figure 5:
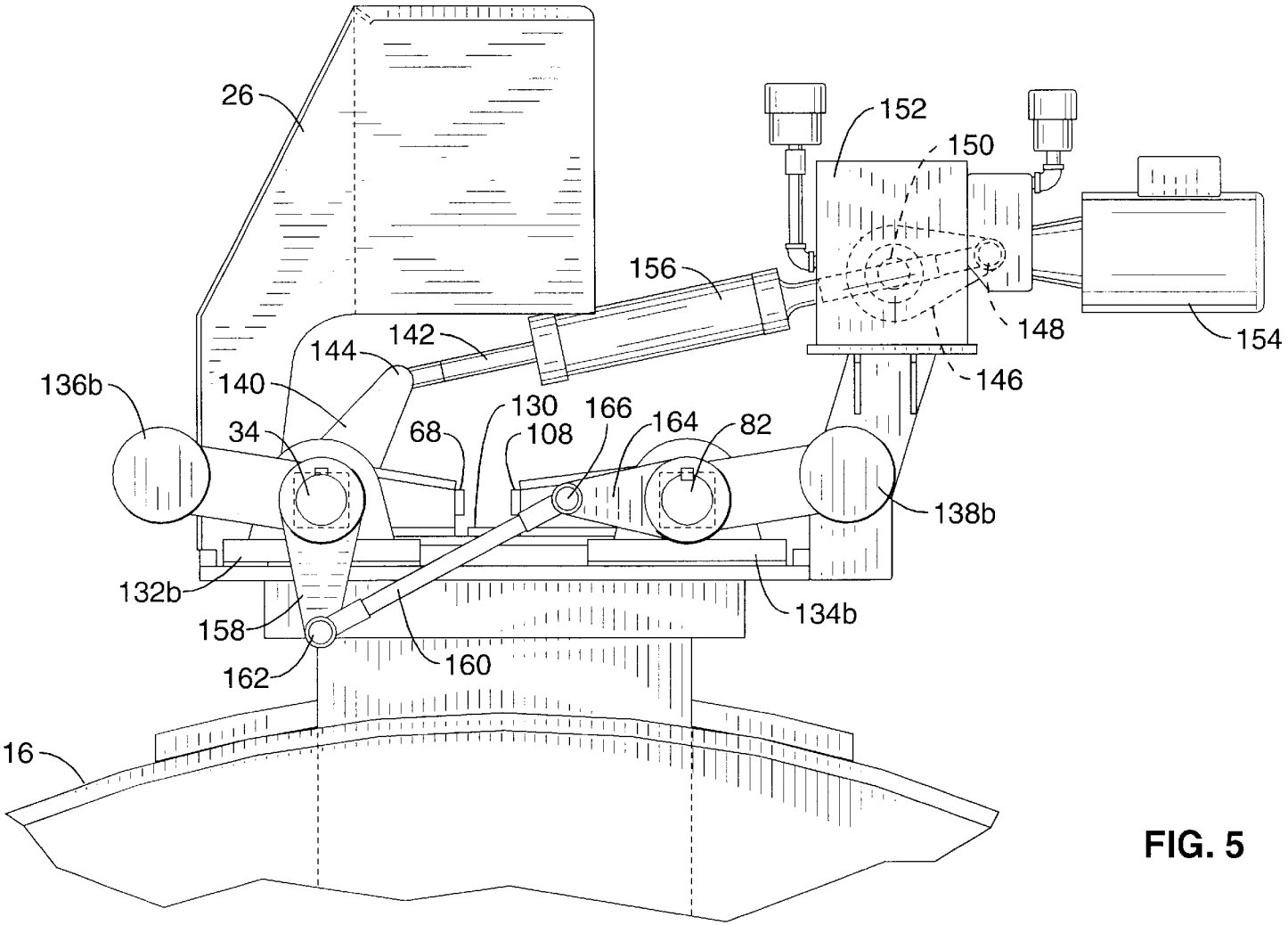
FIG. 5 is a rear view of the feed door assembly of FIG. 1 with the warp resistant doors shown in the closed position.

Referring to FIG. 1, FIG. 4 and FIG. 5, there is a cover 130 that is attached to the outer edge of planar member 22*b* and covers the gap between planar members 22*a* and 22*b* when doors 12*a* and 12*b* are in the closed position. Cover 130 acts to seal the gap between the doors to prevent the escape of significant amounts of combustion gases and heat from the kiln.

The door assembly of the present invention has a front or drive side as seen in FIG. 4 and a rear side as shown in FIG. 5. In the embodiment shown, the ends of pivot shafts 34 and 82 rotate in high temperature pillow block bearings 132*a*, 132*b* and 134*a*, 134*b*, respectively. The pillow block bearings 132*a*, 132*b*, 134*a* and 134*b* are preferably mounted on baseplate 20.

Doors 12*a* and 12*b* are preferably counterweighted to create a zero lift weight and reduce the stress on the door actuating mechanisms. Shaft 34 has a counterweight 136*a* on the drive side and a counterweight 136*b* on the rear side of the apparatus. Similarly, shaft 82 has a counterweight 138*a* on the drive side and a counterweight 138*b* on the rear side of the shaft. The counterweights are preferably placed on the shaft such that the pillow block bearings are between the door and the counterweight.

Referring more particularly to the drive side of the apparatus as shown in FIG. 4, an actuating arm 140 is radially mounted to pivot shaft 34. Force applied to actuating arm 140 will cause pivot shaft 34 to rotate around its axis in block bearings 132*a* and 132*b*.

Actuating arm 140 is pivotally connected to the distal end of cushioned push rod 142 by bearing 144. The proximal end of push rod 142 is rotatably connected to rotating arm 146 by bearing 148. Push rod 142 is preferably coupled to a resistive plunger or spring 156 that will allow the length of pushrod 142 to compress or shorten slightly while resisted by spring 156. This serves to temper the force applied to arm 140 and shaft 34 by pushrod 142 when door 12*a* is opened or closed.

Arm 146 is connected to an output shaft 150 (FIG. 5) of gearbox 152 and rotated by the output shaft at a desired speed. Output shaft 150 and gearbox 152 are preferably driven by an electric motor 154. In use, the electric motor 154 drives gearbox 152 which imparts a rotational motion to arm 146. Push rod 142 forces actuating arm 140 to oscillate. Arm 140 rotates shaft 34 to a point that door 12*a* is opened to a vertical position.

Motor 154 may be activated by any number of timing mechanisms known in the art which allow the doors to be opened at the proper position to receive fuel during rotation of the kiln. The opening and closing of the feed doors can be timed for every cycle of rotation of the kiln or for alternate cycles.

Referring now to FIG, 5, the rear side of the inventive apparatus is shown. A transfer arm 158 is mounted to pivot shaft 34 and rotates with shaft 34 in pillow bearings 132*a* and 132*b* when the shaft is rotated by actuating arm 140. Transfer arm 158 is pivotally connected to one end of transfer rod 160 by transfer arm bearing 162. The other end of transfer rod 160 is pivotally connected to arm 164 through bearing 166. When shaft 34 is rotated, counterweight 136*b* rotates downwardly, transfer arm 158 moves upwardly about the axis of shaft 34 and transfer rod 160 forces arm 164 to rotate pivot shaft 82. Rotation of shaft 82 causes door 12*b* to open upwardly and counterweight 136*b* to rotate downwardly around the axis of shaft 82. It is preferred that door 12*b* open beyond vertical to approximately one hundred and ten degrees from horizontal.

In operation, the opening of doors 12*a* and 12*b* is preferably coordinated with the release of fuel from feed chute 32. It is preferred that the doors do not open when the assembly is below forty degrees from horizontal.

Figure 6:
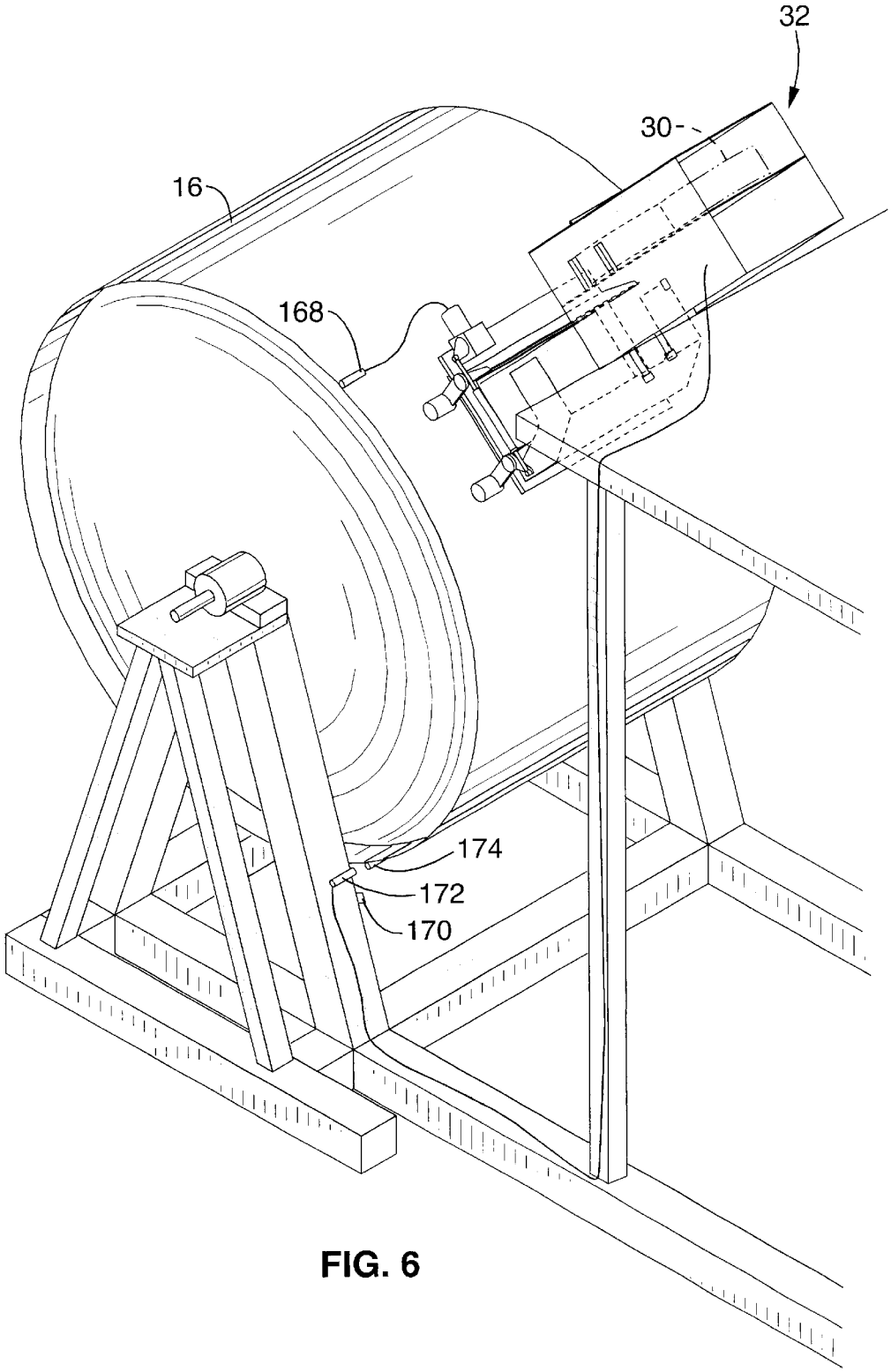
FIG. 6 is a perspective view of a rotating kiln with the attached feed door assembly of FIG. 1 shown the warp resistant doors in the open position to receive secondary fuel from the feed chute.

Referring to FIG. 2 and FIG. 6, in operation a tire 30 is placed on feed chute 32 either manually or by using an auxiliary mechanical feed mechanism (not shown). As kiln 16 rotates, sensor 168, which is a conventional photosensor or the like, senses an actuator key such as tab 170 and activates motor 154 thereby opening doors 12*a* and 12*b*. As rotation continues, the doors completely open and fuel guide 26 and feed opening 14 comes into alignment with feed ramp 32, fuel control sensor 172 detects tab 174 and sends a control signal to feed chute 32. The tire or other combustible material is timed to slide down the feed chute, along fuel guide 26 and planar member 22*a*, and into the kiln since the angle of inclination is sufficient to allow the material to be gravity fed out the end of the feed chute.

The number of times that doors 12*a*, 12*b* open and close may be controlled and coordinated with the release of fuel by feed chute 32 to meter the amount of material injected into the kiln by sensor controllers at the door and feed chute assemblies. (not shown). Accordingly, the door assembly can remain closed until the kiln completes one or more full rotations.

Accordingly, it will be seen that this invention provides a simple and effective way of introducing combustible materials such as tires into a rotating kiln using gravity feed or affirmative injection which can skip one or more revolutions of the kiln. The structure of the fuel feed doors allow for exposure to extreme temperatures and inconsistent expansion and contraction without warping, fracturing the bearings, shaft distortion, jamming or significant release of heat or combustion gases. Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A warp resistant door, comprising:

a pivot shaft;

a plurality of support arms attached to said pivot shaft;

each said support arm including at least one anchor arm, said anchor arm including a plurality of oblong shaped bores;

a door plate; and a plurality of fasteners coupling said door plate to said anchor arms, wherein said fasteners are disposed in said bores.

2. The warp resistant door as recited in claim 1, wherein said oblong bores have a major axis and a minor axis;

wherein said support arms have a longitudinal axis; and wherein the major axis of the bores is substantially parallel to the longitudinal axis of the arm.

3. The warp resistant door as recited in claim 1, wherein said oblong bores have a major axis and a minor axis;

wherein said support arms have a longitudinal axis; and wherein the major axis of the bores is substantially perpendicular to the longitudinal axis of the arm.

4. The warp resistant door as recited in claim 1, wherein said bores in said anchor arms comprise a combination of circular-shaped bores and oblong-shaped bores.

5. The warp resistant door as recited in claim 1, further comprising a bushing located within each of said bores, wherein said fasteners are disposed with said bushings.

6. The warp resistant door as recited in claim 1, further comprising a cross-brace interconnecting said anchor arms.

7. The warp resistant door as recited in claim 1, wherein said door further comprises a counterweight attached to the shaft opposite said anchor arms.

8. The warp resistant door as recited in claim 1, wherein said door further comprises a seal member at the periphery of said plate.

9. A warp resistant door; comprising:

a shaft rotatably coupled to a base;

a plurality of anchor arms mounted to said shaft, said anchor arms having a plurality of apertures;

a door plate, said door plate having a plurality of oblong shaped apertures; and a plurality of fasteners coupling said door plate to said anchor arms.

10. The warp resistant door as recited in claim 9, wherein said door further comprises a counterweight attached to the shaft opposite said anchor arms.

11. The warp resistant door as recited in claim 9, wherein said base further comprises a seal.

12. The warp resistant door as recited in claim 9, wherein said fasteners coupling said door plate to said anchor arms comprise a plurality of bolt fasteners, said bolt fasteners disposed within said plurality of apertures within said anchor arms and within said door plate.

13. The warp resistant door as recited in claim 12, further comprising a bushing disposed within said apertures of said anchor arms and said door plate, said bolt fasteners disposed within said bushing.

14. The warp resistant door as recited in claim 9, wherein said anchor arms further comprise a combination of circular-shaped bores and oblong-shaped bores.

15. The warp resistant door as recited in claim 9, wherein said apertures in said anchor arms comprise a combination of oblong-shaped bores oriented laterally and oblong-shaped bores oriented longitudinally.

16. The warp resistant door as recited in claim 9, wherein said door further comprises a seal member at the periphery of said door plate.

17. A warp resistant door, comprising:

a plurality of hinges;

a door plate;

a plurality of anchor arms attached to said hinges, said anchor arms having a plurality of bores, said bores configured to allow a longitudinal and a lateral expansion and contraction of the door plate;

a plurality of fasteners coupling said door plate to said anchor arms; and a cross brace coupling said plurality of anchor arms together.

18. The warp resistant door as recited in claim 17, wherein said oblong bores have a major axis and a minor axis;

wherein said support arms have a longitudinal axis; and wherein the major axis of the bores is substantially parallel to the longitudinal axis of the arm.

19. The warp resistant door as recited in claim 17, wherein said oblong bores have a major axis and a minor axis;

wherein said support arms have a longitudinal axis; and wherein the major axis of the bores is substantially perpendicular to the longitudinal axis of the arm.

20. The warp resistant door as recited in claim 17, wherein said bores in said anchor arms comprise a combination of circular-shaped bores and oblong-shaped bores.

21. A warp resistant door, comprising:

a pivot shaft;

a plurality of support arms attached to said pivot shaft;

each said support arm including at least one anchor arm, said anchor arm including a plurality of circular and oblong shaped bores;

a door plate;

a plurality of fasteners coupling said door plate to said anchor arms, wherein said fasteners are disposed in said bores; and a cross brace coupling said plurality of anchor arms together.

22. The warp resistant door as recited in claim 21, wherein said oblong bores have a major axis and a minor axis;

wherein said support arms have a longitudinal axis; and wherein the major axis of the bores is substantially parallel to the longitudinal axis of the arm.

23. The warp resistant door as recited in claim 21, wherein said oblong bores have a major axis and a minor axis;

wherein said support arms have a longitudinal axis; and wherein the major axis of the bores is substantially perpendicular to the longitudinal axis of the arm.

24. The warp resistant door as recited in claim 21, further comprising a plurality of bushings disposed within said bores in said anchor arms.

25. The warp resistant door as recited in claim 21, wherein said door further comprises a counterweight attached to the shaft opposite said anchor arms.

26. The warp resistant door as recited in claim 21, wherein said fasteners coupling said door plate to said anchor arms comprise a plurality of bolt fasteners, said bolt fasteners disposed within said plurality of bores within said anchor arms and within said door plate.

* * * * *